United States Patent [19]

Richter et al.

[11] Patent Number: 4,750,343

[45] Date of Patent: Jun. 14, 1988

[54] DEVICE FOR DETECTING AND REGULATING THE PLANENESS OF STRIP-SHAPED ROLLED PRODUCTS, ESPECIALLY THIN-GAGE STRIPS, FOR COLD ROLLING MILLS

[76] Inventors: Gerhard Richter, 6, Charlottenstrasse, Kreuztal 5; Hans-Peter Richter, 6, Kalkbitze, D-5241 Friedewald; Axel Barten, 227, Siegener Strasse, D-5910 Kreuztal, all of Fed. Rep. of Germany

[21] Appl. No.: 736,319

[22] Filed: May 21, 1985

[30] Foreign Application Priority Data

May 23, 1984 [DE] Fed. Rep. of Germany ..... 3419261

[51] Int. Cl.[4] ..... B21B 37/06; B21B 27/10

[52] U.S. Cl. ..... 72/17; 72/201; 72/236

[58] Field of Search ..... 72/8, 9, 10, 11, 12, 72/16, 17, 201, 236; 73/159, 862.07

[56] References Cited

U.S. PATENT DOCUMENTS

| | | | |
|---|---|---|---|
| 3,474,668 | 10/1969 | Mangan | 73/159 |
| 3,784,153 | 1/1974 | Ross et al. | 72/201 |
| 3,902,363 | 9/1975 | Ishimoto | 73/862.07 X |
| 4,188,809 | 2/1980 | Ishimoto et al. | 72/17 |
| 4,262,511 | 4/1981 | Boisvert et al. | 72/17 |
| 4,528,756 | 7/1985 | Ichihara | 72/12 |
| 4,706,480 | 11/1987 | Svatos | 72/17 |

FOREIGN PATENT DOCUMENTS

| | | | |
|---|---|---|---|
| 0049425 | 4/1982 | European Pat. Off. . | |
| 130319 | 10/1980 | Japan | 72/236 |
| 81916 | 5/1982 | Japan | 72/201 |
| 982231 | 2/1965 | United Kingdom . | |
| 1160124 | 7/1969 | United Kingdom . | |
| 1225520 | 3/1971 | United Kingdom . | |
| 1231008 | 5/1971 | United Kingdom . | |
| 1326157 | 8/1973 | United Kingdom . | |
| 2012198 | 7/1979 | United Kingdom . | |

OTHER PUBLICATIONS

"Regelung der Bandplanheit in Kaltwalzwerken" *BBC-Nachrichten,* by Von Reinhard Oberhaus, Heft 11, 1980, pp. 451–456.

"Automatic Flatness Control System for Cold Rolling Mills", *Iron and Steel Engineer,* Jun. 1979, by Ake Nilsson, pp. 55–60.

"Control of Strip Flatness in Cold Rolling Mills", Reinhard Oberhaus, *BBC Publication No. D1A144080E,* Germany, pp. 1–7.

*Primary Examiner*—Robert L. Spruill
*Assistant Examiner*—Steven B. Katz
*Attorney, Agent, or Firm*—Young & Thompson

[57] ABSTRACT

The device for the detection and regulation of the planeness of strip-shaped rolled products, especially thin-gage strips (1), for cold rolling mills comprises a planeness measuring system with individual measuring elements, which system includes, for example, a planeness measuring roller (3) composed of individual measuring disks (4) with force measuring transmitters arranged along the circumference. By the planeness measuring roller (3), the strip tensile stress is measured over the strip width (5), from which is calculated the longitudinal distribution ($\Delta L/L$) over the strip width as a characteristic variable for the strip planeness. Regulation of the strip tensile stress is effected by installations for cooling and/or lubrication and/or bending and/or pivoting of the rolls. Measuring units (6) for measuring the position of the strip edges (7, 8) with respect to the planeness measuring roller (5) and detecting the thus-given overlapping of the measuring disks (4), located in the zone of the strip edges (7, 8), of the measuring roller (3), by the strip (1) are arranged on both sides of the traveling strip, for an exact determination of the strip tensile stress in the marginal zones of the strip (1).

1 Claim, 2 Drawing Sheets

DEVICE FOR DETECTING AND REGULATING THE PLANENESS OF STRIP-SHAPED ROLLED PRODUCTS, ESPECIALLY THIN-GAGE STRIPS, FOR COLD ROLLING MILLS

FIELD OF THE INVENTION

The invention relates to a device for the detection and regulation of the planeness of strip-shaped rolled products, especially thin-gage strips, for cold rolling mills.

BACKGROUND OF THE INVENTION

The requirements to be met by the dimensional and configurational accuracy of cold-rolled thin-gage strip have considerably increased during the course of the development of rolling technique and further processing. An ideal cold-rolled strip not only is to exhibit the same thickness over length and width, but also is to lie completely planar. In this connection, planeness is to be preserved even if the strip is cut into sections during further processing.

These requirements with respect to dimensional accuracy and planeness of a thin-gage strip cannot be met, however. For example, if an attempt is made to cold-roll a hot-rolled strip, somewhat thinner along the edges than in the center, so that its thickness is completely the same over its width, this requires a larger reduction in thickness and thus greater stretching in the center of the strip, leading to the formation of central waviness. In contrast, if the best possible planeness is desired, this is achieved at the cost of transferring the profile shape of the hot-rolled strip to the cold-rolled strip.

Flaws in planeness can appear after rolling or as late as during the subsequent further processing. During rolling, flaws in planeness are essentially a consequence of differing stretching over the strip width on account of non-uniform shaping of the strip in the roll nip over the strip width. During further processing, for example during slitting, flaws in planeness frequently occur by the triggering of natural stresses produced during rolling.

One differentiates between flaws in planeness that can be levelled by stretching and those which cannot be levelled by stretching. Capable of being levelled by stretching applies to those flaws where the strip deviates uniformly from planeness in the width direction. In this case, mutually opposed natural stresses occur on the topside and on the underside of the strip. These stresses are constant over the entire width. Unevennesses that can be levelled by stretching are characterized in that they are linearly delimited in one direction, i.e. in the longitudinal direction or in the transverse direction.

Deviations in planeness variable over the strip width and length are characterized by curved boundaries and cannot be stretched level by means of a simple bending process. In this case, non-uniform natural stress distributions are present in the longitudinal and transverse directions. Such planeness flaws appear as central and marginal waviness in the cold-rolled strip.

During the cold rolling of strips of steel or aluminum, differences in length and/or the differing stretching over the strip width are at least partially compensated by the elastic elongation on account of strip tension so that there is no unequivocal criterion, in the rolling procedure, for unduly high strip tensions, especially in the marginal zones of the strip, which lead to strip fissures. This lack of information can have the result that the rolling efficiency existing in many rolling mills is not exploited and thus economical operation is not ensured.

The high requirements regarding the quality of rolled thin-gage strip have resulted in the development of measuring units to detect the planeness during cold rolling, permitting, together with the adjusting procedures for the roll nip, the building up of a closed control circuit for planeness, by means of which the tensile force exerted on the strip over the strip width in the outlet of a set of rolls can be regulated only with approximate constancy.

The planeness measuring roller utilized in the device for detecting and regulating the planeness of thin-gage strip exhibits the drawback that the tensile stress distribution in the strip, as a characteristic value for planeness, is measured in the individual strip fibers and/or strip zones in the edge regions of the strip only very inaccurately so that planeness control of this known device operates very imperfectly.

OBJECT OF THE INVENTION

The invention is based on the object of improving the conventional device with respect to accuracy of measurement and regulation of planeness.

This object has been attained according to this invention by the features hereinafter recited.

BRIEF DESCRIPTION OF THE DRAWINGS

The invention will be described in detail below with reference to the drawings showing the device for measuring and regulating the planeness of rolled thin-gage strip utilized in a four-high rolling mill. The figures show, each in schematic representation.

DETAILED DESCRIPTION OF THE INVENTION

Figure 1:
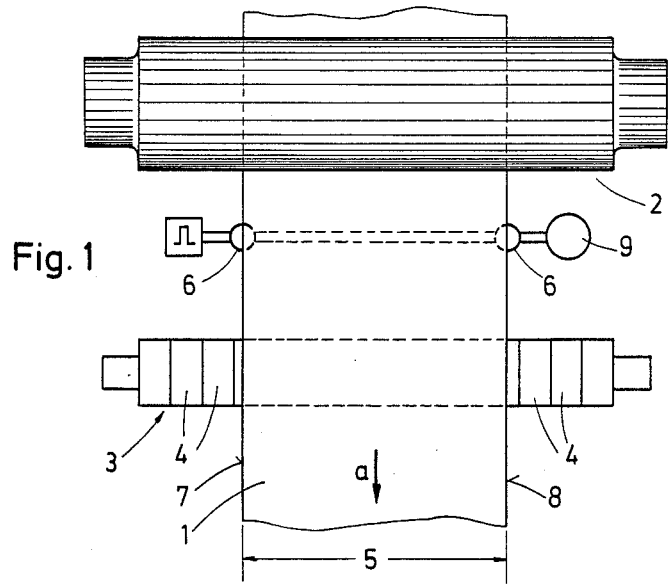
FIG. 1 a top view of the measuring and regulating device of this invention.

The device for detecting and regulating the planeness of rolled thin-gage strip 1 for cold rolling mills comprises a planeness measuring roller 3 installed in the strip outlet downstream of the set 2 of rolls of a rolling mill stand, not shown, this measuring roller being composed of individual measuring disks 4 with force measuring transmitters arranged along the circumference, these transmitters serving for regional measurement of the strip tensile stress over the strip width 5. With the aid of the relationship $\Delta\sigma/E$ wherein $\Delta\sigma$ is the difference in tension between two neighboring marginal zones and/or fibers and E is the modulus of elasticity of the strip material, the longitudinal distribution $\Delta L/L$ over the strip width 5 is calculated, from the measured tensile stresses of the strip, as a characteristic variable for the strip planeness.

Seen in the travel direction a of the strip, measuring units 6 are installed upstream of the planeness measuring roller 3 on both sides of the run of the strip, in order to measure the position of the strip edges 7, 8 with respect to the planeness measuring roller 3, from which results the overlapping of the measuring disks 4 of the measuring roller 3 located in the zone of the strip edges 7, 8.

With the aid of the servomotors 9, the measuring units 6 are preposed to the exact central pass of the strip 1 with a predetermined required width. During operation, the measuring units 6, scanning the strip edges 7, 8 of the traveling strip 1, continuously transmit signals, which latter change in case of an eccentric travel of the strip 1 proportionately to the positional variation of the strip edges with respect to the measuring roller 3.

The actual strip tensile stress present in the marginal zones of strip 1 is determined in such a way that the strip tensile stresses measured by the two measuring disks 4 of the measuring roller 3 in the zone of the strip edges 7, 8 are corrected in correspondence with the overlapping of the measuring disks 4 by the strip detected by the measuring units 6.

Suitable measuring means for measuring the position of the strip edges are optical, inductive or pneumatic devices.

The strip tensile stress measured over the strip width is a reflection of all influential variables acting on the roll nip configuration and thus also on the reduction of the strip in the roll nip.

The regulation comprises adapting the influential variables to one another in such a way that a uniform pass reduction results in the roll nip, and thus a constant distribution of the strip tensile stress over the strip width is achieved in the outlet. Suitable as setting data for such a control are only short-term-variable influential variables which are not determined by other technological requirements. Consequently, the adjusting elements available are restricted to cooling and lubrication of the rolls, roll rebending and an oblique positioning of the rolls perpendicularly to the rolling plane.

Figure 3:
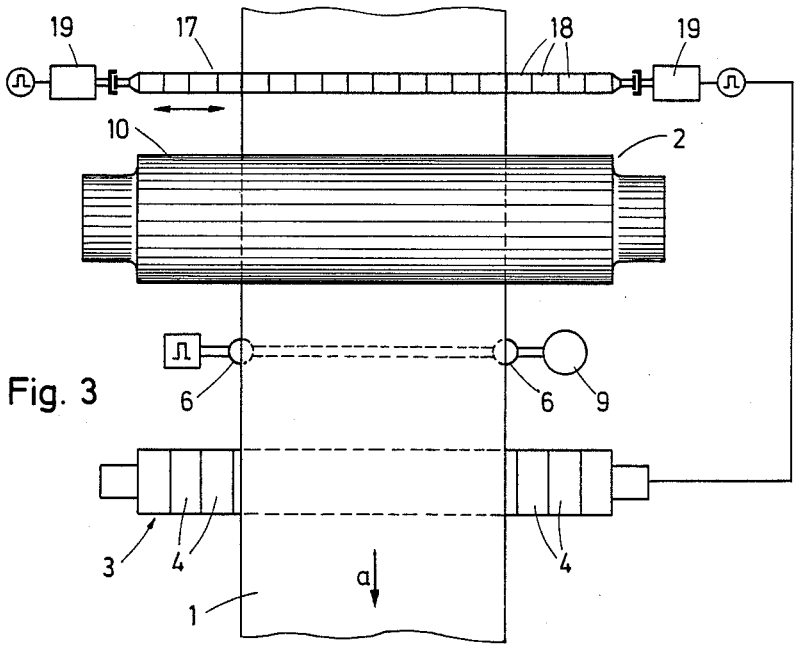
Figure 2:
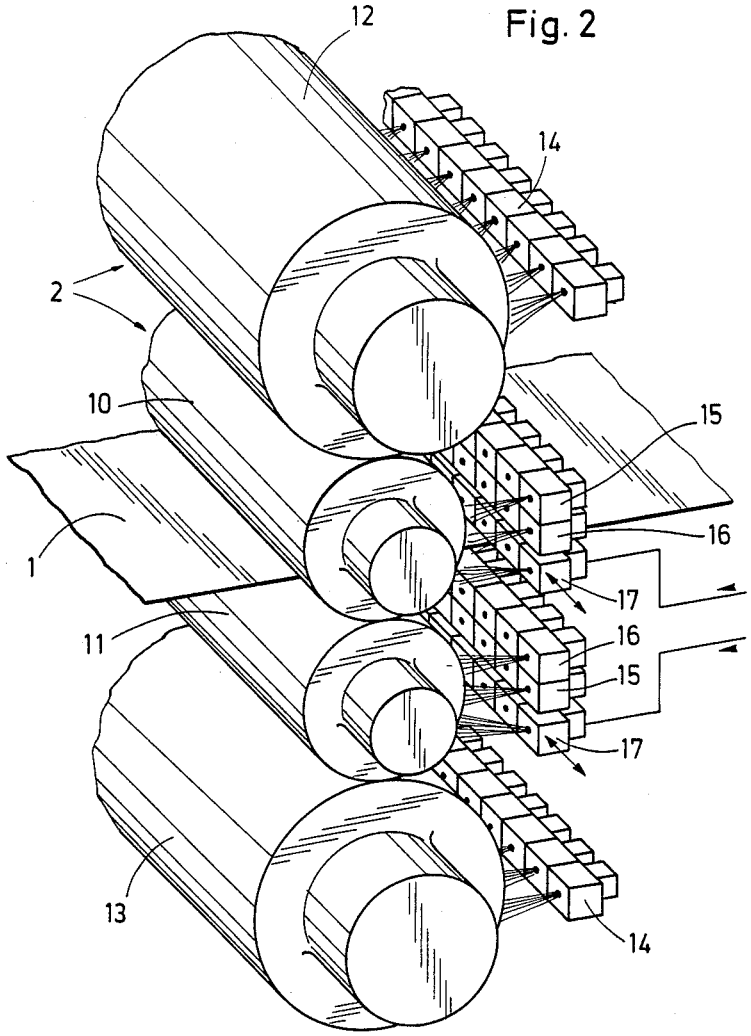
FIG. 2 a perspective view of the set of rolls of a four-high rolling mill, equipped with a cooling and lubricating installation operating according to the regulating device of this invention, and FIG. 3 a top view of the adjustable cooling and lubricating installation for a work roll of the four-high rolling mill of FIG. 2.

The roll cooling and lubricating installation, usable for planeness regulation, as shown in FIGS. 2 and 3 for the work rolls 10, 11 and backup rolls 12, 13 of a four-high rolling mill consists of respectively one nozzle beam 14 for the backup rolls 12, 13 and respectively three nozzle beams 15–17 for the work rolls 10, 11. Spray nozzles 18 for the application of cooling oil and/or emulsions to the rolls 10–13 are mounted in the nozzle beams 14–17. The nozzle beams 14–16 are stationary whereas the nozzle beams 17 are movable by means of the drive mechanisms 19 transversely to the travel direction a of the strip over the width of the latter. Furthermore, the spacing of the nozzle beams 17 with respect to the roll set 2 is adjustable. Finally, it is possible to provide additionally a mutual, continuous adjustability transversely to the strip traveling direction a and a rotary adjustment of the nozzles 18 of both nozzle beams 17.

The respective feeding of rolling oil and/or emulsion to the adjustable nozzle beams 17 is controlled in dependence on the pressure and/or quantity and/or temperature.

By the adjustability of the nozzle beams 17 and of the nozzles 18 installed therein, the spray zone width of the nozzles on the rolls, and the spray pattern of the nozzles, are adjusted. The regulation of pressure, temperature and amount of the rolling oil fed to the nozzle beams 17 and/or of the emulsion fed thereto affects the cooling of the work rolls 10, 11 and consequently the magnitude and rapidity of the change in effective roll body diameter and/or the lubrication of the work rolls.

The values for the strip tensile stress distribution over the strip width, measured by the planeness measuring roller 3, are processed in a computer and utilized for regulating the cooling and/or lubrication of the work rolls 11, 12 by means of the movable nozzle beams 17.

The adjustability of the nozzle beams 17 transversely to the travel direction a of the strip, and the pivotable arrangement of the nozzles 18 in the nozzle beams 17, make it possible within the scope of planeness regulation to effect exact positioning of the nozzle beams 17 and of the nozzles 18 with respect to the work rolls 11, 12 and optionally also the backup rolls 12, 13, and thereby provide formation of narrowly limited cooling zones on the rolls over the roll width, the cooling zones corresponding to the strip zones detected by the measuring disks 4 of the planeness measuring roller 3. The aforedescribed mode of operation of the roll cooling installation offers the possibility of eliminating by means of regulation, with maximum accuracy, any undesirable deviations in strip tensile stress in the rolled strip 1 within specific areas, particularly in the marginal zones of the strip.

What is claimed is:

1. In combination with a roll (10 or 11) of a cold rolling mill for thin gage metal strip, an installation for directing a liquid against said roll, said installation comprising a plurality of elongated nozzle beams (15, 16, 17) that are parallel to said roll and to each other, at least one (15, 16) of said beams being stationary, each of said beams having a plurality of spray nozzles (18) arranged along the length thereof, said nozzles being directed at said roll to spray a liquid against the roll, detector means (3, 4) for detecting tensile stresses in a plurality of zones of a said strip across the width of the strip, and means (19) responsive to said detector means for moving one (17) of said beams lengthwise parallel to said roll and relative to said at least one stationary (15, 16) beam thereby to provide formation of narrowly limited cooling zones on the rolls over the roll width, said cooling zones corresponding to the strip zones detected by said detector means, thereby to eliminate by means of regulation, with maximum accuracy, any undesirable deviations in strip tensile strength in the rolled strip within specific areas.

* * * * *